US006393871B1

(12) United States Patent
Chiang

(10) Patent No.: US 6,393,871 B1
(45) Date of Patent: May 28, 2002

(54) CONTINUOUSLY AND COMBININGLY OPERABLE BREADTH EXPANSION AND VIBRATION ENHANCED SPRAY DYEING MACHINE

(76) Inventor: Chao-Cheng Chiang, 5F-2, No. 455, Chung Cheng Rd, Yung-Ho City, Taipei Hsien (TW)

( * ) Notice: Subject to any disclaimer, the term of this patent is extended or adjusted under 35 U.S.C. 154(b) by 0 days.

(21) Appl. No.: 09/437,292

(22) Filed: Nov. 9, 1999

(51) Int. Cl.[7] ..... D06F 3/20

(52) U.S. Cl. ..... 68/5 D; 68/18 F; 68/178; 68/205 R

(58) Field of Search ..... 68/5 D, 5 E, 18 F, 68/178, 205 R

(56) References Cited

U.S. PATENT DOCUMENTS 4,644,765 A * 2/1987 Kito ..... 68/205 R X
5,014,525 A * 5/1991 Bene ..... 68/178 X
5,775,136 A * 7/1998 Chao-Chang ..... 68/178 X

* cited by examiner

*Primary Examiner*—Philip R. Coe
(74) *Attorney, Agent, or Firm*—Dougherty & Troxell

(57) ABSTRACT

A continuously and combiningly operable breadth expansion and vibration enhanced spray dyeing machine, which can provide dyeing and other processing operations on a fabric in a continuous way. The dye and treating agents are spraying onto the fabric. By a high speed air flow, the fabric can have a violent vibration to speed up the processing effect. Therefore, the fabric can be processed with small amount continuous dyeing and other processing operations in a short period of time.

7 Claims, 7 Drawing Sheets

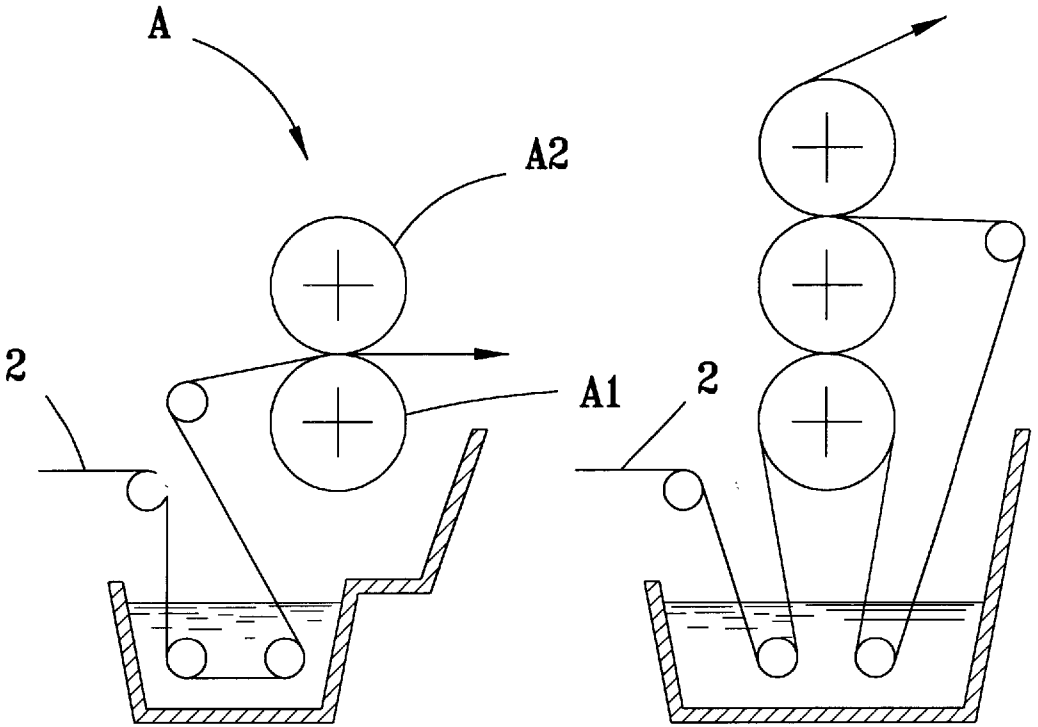
FIG.3(A)
PRIOR ART
FIG.3(B)
PRIOR ART
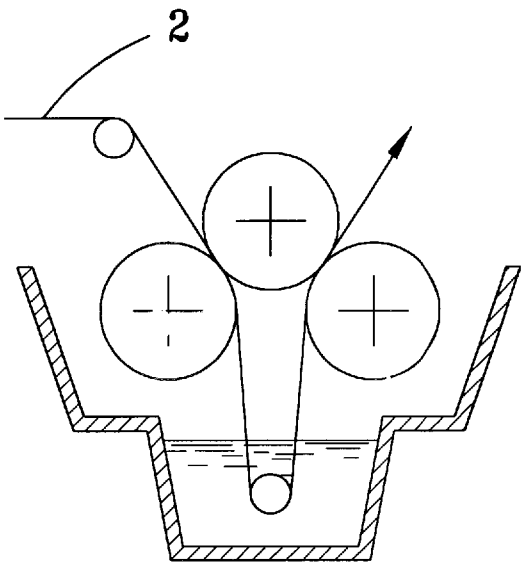
FIG.3(C)
PRIOR ART

CONTINUOUSLY AND COMBININGLY OPERABLE BREADTH EXPANSION AND VIBRATION ENHANCED SPRAY DYEING MACHINE

BACKGROUND OF THE INVENTION

1. Field of the Invention

The present invention relates generally to a continuously and combiningly operable breadth expansion and vibration enhanced spray dyeing machine (hereinafter as "continuous spray dyeing machine") which is an highly efficient environment-preserving continuous spray dyeing and processing apparatus.

2. Description of the Prior Art

The term continuous spray dyeing machine used herein is intended to indicate a dyeing and processing apparatus which provides the fabric continuous dyeing and other processing. The fabric is continuously proceeded and substantially fully expanded in the breadthwise direction. The liquid dye and other fabric treating agents are brought into contact with the fabric in an atomized form by means of spray nozzles arranged above the fabric. A high speed air stream is formed under the fabric to create a low pressure zone which causes a pressure difference between the upper and lower sides of the expanded fabric. The static pressure above the fabric is greater than the pressure below so that the fabric can not only levitated and freely expanded in breadth direction via the high speed stream of air flow, but the fabric in motion can also periodically vibrate violently via the unbalanced pressure.

This vibration provides the energy for the dye, treating agents, or oxidation gases to penetrate into the fabric texture so as to enhance the absorption rate and diffusion speed of the dye into the fabric. Thus a continuous dyeing and processing operation with high efficiency, low energy consumption, low bath ratio and low pollution may be achieved.

The present invention is particularly related to an effect that is caused by the high speed air streams formed by a cloth guide tube. This does not only enhance the penetration and diffusion of the dye, but also speeds up the penetration of the oxidation gases to have a quick dye development when performing low temperature oxidation reduction dyeing. When performing other processing, It also provides a very efficient way to remove unwanted particles or impurities from the fabric so as to efficiently finish the operations of desizing, scouring, bleaching, soaping, reduction, enzyme treating, rinsing, relaxation, and drying. Therefore, the present invention can complete the overall dyeing and processing operations in a very short time as compared with the conventional dyeing apparatuses.

A conventional continuous dyeing machine is defined to be one that combines more than two machines with different functions to perform the dyeing process in a continuous way. When dyeing, there are three steps: dye padding, dye development and fixation, and washing and drying operations. The popular conventional continuous dyeing machines are developed by improving the design of the dye padding operation. To accomplish some operation, some designs follow a particular dyeing method; others choose a specific combination of individual machines. Therefore, to obtain a most reasonable manufacturing procedure or due to the limitation of the factory environment, the preprocessing operations are usually separated from the dyeing operation. Please refer to FIGS. 1 and 2. FIG. 1 is a side view of the combined structure of a conventional dye padding continuous dyeing machine. FIG. 2 shows a side view of a conventional continuous breadth expansion washing machine. Referring to FIG. 1, the combined structure comprises (listed according to the manufacturing order): a dye padding machine A, a steamer or a dryer B, an air oxidation machine C, a treating agent padding machine D, a steamer E, a washer F, a water remover G, and a dryer H. All the machines are connected in series and the fabric is drawn by the driving roller and cloth guide axis on each machine to continuously pass through each machine. To keep the fabric proceeding in a continuous way and fully expanded in width, the longitudinal and transverse directions of the fabric have to be stretched with a big tension.

Therefore, referring to FIG. 3A, the conventional continuous dyeing machine drags the fabric to pass the dye padding machine A and absorb the dye by a driving roller A1 and a pressure roller A2 on the dye padding machine. Thus, the size of the contact surface between the two rollers directly affects the dye padding rate, which in turn affects the depth of dyeing. To prevent the occurrence of color difference on both sides of the fabric, in addition to apply even pressures on both sides of the dye padding roller, the middle of the pressure roller must meet a crown standard so that the dye and treating agents can be evenly distributed. FIGS. 3B and 3C are the side views of the other commonly seen dye padding machines. The fabric past the dye padding machine A is immediately sent into and passes through the steamer B. There are many different forms for the steamer B, but all perform a single operation. It is different from the usual discontinuous dyeing machine. For example, the air flow type or liquid flow type dyeing machine can simultaneously perform continuous dye cycling and support to perform dyeing at the same time. The fabric passes through the steamer B or the air oxidation machine C to have the dye developed and fixed. The proceeding of the fabric is supported by a cloth guide axis set B1. When the dye gets fixed, the fabric is then guided into the washer F to remove the unfixed dye, remaining chemicals, or other impurities. Usually, the washer F has each tub as a unit F1 and several units are connected into a group. In the tubs are stored with a larger amount of water. A water removing pressure roller F2 is provided at the upper outlet of each tub. For the usual washers, a group has at least three tubs and up to fifteen tubs. The number depends upon the processing after dyeing. In conventional dye padding machines and steamers, the processing after dyeing includes operations such as re-oxidation, acid washing, neutralizing, hot showering, soaping, hot showing, and cold washing. Therefore, the washer with a group of seven to nine tubs is the best choice. After water washing and water removing, the fabric is guided into the dryer H to get dried. Usually, the dryer is consisted of several drying tubs. After dye padding, the fabric needs to be processed by dye development and fixation immediately and thus the dye development and fixation processing machine should be attached immediately after the dye padding machine.

So the conventional continuous dyeing machine is formed by connecting several different machines together to achieve the goal of continuous dyeing and processing.In practice, using the dye padding machine A to dye and proceed the fabric often makes the fabric without soft touch or has the problem of linearly folded dyeing. To ensure that the fabric can be fully expanded in width for dyeing and proceeding, the longitudinal tension is often greater than 1.5 kgF (per centimeter in width) in addition to the stretching in the transverse direction by a fabric stretching machine. Therefore, conventional continuous dyeing machines can only perform dyeing and processing on a tatted fabric, but the problem existing in the knitted or elastic fabric could not be resolved to date. Furthermore, in the dyeing process by the dye padding machine, although a small liquid amount dyeing can be achieved, yet the dyeing process can only be performed once. When performing dye development and fixation in the steamer, it cannot continuously supply the dye at the same time, and therefore the fabric can not obtain a deep color. When washing the fabric, a large amount of water is needed for cleaning. For a new generation of environment-preserving dyeing machine, the above mentioned continuous dyeing machine obviously needs many improvements and modifications.

Please refer to FIG. 4, which shows another spray dyeing apparatus with breadth expansion and vibration-enhanced dyeing operation invented by the inventor of this current invention. It is disclosed in the R.O.C. Pat. No. 098,316, the U.S. Pat. No. 5,775,136, and the PCT Pat. No. WO98/49383. The present invention is an improved invention derived from the existing technology principles and characteristics.

Please refer to FIGS. 4 and 6. FIG. 4 is a side view of a spray dyeing apparatus with breadth expansion and vibration-enhanced dyeing operation. FIG. 6 is a side view of the structure of a continuous spray dyeing machine according to the instant invention. The part of air guiding nozzle design is almost the same in the principle and structure. However, the application of the air guiding nozzles in the current invention is different from the previous patent. For the convenience of the examination procedure, this point has to be explained. The biggest difference is that the previous case is a discontinuous dyeing apparatus which can only provide a small amount of dyeing and processing; yet the continuous spray dyeing machine in the present invention can not only continuously perform processing in a processing tub, but also, by connection with other machines, continuously complete the operations such as dyeing, treating agents absorption, steam dye development, air dye development, dye fixing, washing, and drying. In particular, to facilitate even absorption or to promote the production rate, the processing tubs can be arbitrarily added to obtain the necessary quality and production rate. Therefore, in observation of the defects in the discontinuous spray dyeing apparatus with breadth expansion and vibration-enhanced dyeing operation and the above mentioned conventional continuous dyeing machines, the application technology of the air guiding nozzles should be improved for a better environment-preserving dyeing method. Accordingly, the inventor hereby provides another mass production type continuous dyeing apparatus.

SUMMARY OF THE INVENTION

The present invention provides a continuous spray dyeing machine, which allows the fabric to be levitated, expanded, and violently vibrated by a high speed air flow in dyeing and other processing operation so as to complete the processing in a short period of time.

The invention also provides knitted fabrics or other elastic fabrics a breadth expansion continuous dyeing and processing. Furthermore, the present invention provides a continuous spray dyeing machine, which can achieve the goal of continuous processing by combining different machines. It can also be arbitrarily modified, adjusted, expanded or reduced according to the manufacturing procedure and, therefore, can obtain the most economical dyeing and processing operations.

Yet, the present invention provides a continuous spray dyeing machine, in which the fabric is proceeded simultaneously in each sector in a folding collective way. In each sector, the fabric is dragged by one cloth-dragging wheel. Thus the tension on the fabric can be minimized and the usual bad soft touch problem of the fabric processed by ordinary padding continuous dyeing machines can be improved.

Moreover, the present invention provides a continuous spray dyeing machine, which can not only provide usual dispersive and reactive dyes, but also perform the spray dyeing operation with low temperature reduction dye liquor under a nitrogen gas (inert gases) mediated environment in the upstream processing tubs. When the fabric passes through the next processing tub, the reduction dye liquor can be oxidized for dye development by the large amount of fresh air sprayed out of the air guiding nozzles.

Yet further, the present invention provides a continuous spray dyeing machine, in which the lower side of the fabric is provided with a high speed air flow for the fabric to periodically vibrate violently when the fabric pass through each processing tub. Therefore, dyeing, treating agents or re-oxidation air can quickly penetrate into the fabric texture with the help of this vibration so that a highly efficient small amount dyeing and processing operations can be achieved.

A further object of the present invention is to provide a continuous spray dyeing machine, in which the lower side of the fabric can be provided with a high speed air flow containing dyes or a large amount water ejected from the air guiding nozzles when washing or dyeing the fabric with a compact texture. The fabric thus processed can be dyed on both sides and the impurities remaining on the fabric can be quickly diffused into water.

So the present invention can achieve the goal of instant washing and enhanced dyeing.Yet, another object of the present invention is to provide a continuous spray dyeing machine, which can, in addition to providing a small amount, high concentration dyeing via a periodically violent vibration on the fabric, enhance the removing ability of the impurities existing in the texture so that operations such as desizing, scouring, bleaching, soaping, washing can be quickly finished.

So the invention provides a highly efficient cleaning effect for the dyed fabric. Moreover, the present invention provides a continuous spray dyeing machine, which can not only provide dyeing and other wet type processing operations, but also dries the fabric by the dry and hot air flow coming out of the air guiding nozzles.It can blow the outer cold air to lower the temperature.

To achieve the above objects, the continuous spray dyeing machine provided by the instant invention has processing tubs for connections to perform simultaneous dyeing, wherein each processing tub is designed with the same principle and structure. The processing tub comprises a cloth collecting tub, a cloth guide tube, an air guide nozzle, cloth dragging wheel, a blast machine, a dye pump, a cloth wiggling machine, an air heater, a dye heater, an air cooling inlet, an exhaust outlet, a nitrogen inlet, a steam inlet, an air filter, a dye filter, pipes connecting each parts and controlling elements for each part.

Each of the front and rear ends of the processing tub of the continuous spray dyeing machine of the invention is provided with a passage, the left and right sides and the left and right walls of the processing tub form a parallel wide passage for the fabric to enter and pass through in a breadth expansion way. A cloth collecting tub is provided under the passage entrance close to the bottom of the tub in the upstream sector where the fabric can be folded and collected to an expected amount. The fabric then slows down in moving so as to disperse the tension in continuous proceeding. A cloth guide tube is formed in the downstream of the passage. One or a plurality of sector separated air guiding nozzles are provided along the direction of the passage on the cross section of the side wall under the cloth guiding tube. These nozzles are connected by pipes to a blast machine for guiding and ejecting pressurized air. One or a plurality of dye nozzles are provided above the cloth guide tube and connected with pipes to the dye pump for guiding and ejecting the dye or treating agents onto the surface of the fabric. A dynamical cloth dragging wheel is provided under the downstream outlet of the passage for dragging the fabrics in the cloth collecting tub to pass through the cloth guide tube. The fabric can then continuously proceed to enter the next processing tub and receive another processing operation. Therefore, when performed with dyeing and other processing operations, the fabric can have a full contact with the atomized dye particles ejected out of the dye nozzles to achieve the goal of small amount dyeing. Whenever the fabric gets in touch with the dye, the fabric generates a periodically violent vibration due to the high speed air flow ejected from the air guide nozzles. Thus, the dye, and chemicals or re-oxidation gas can obtain the energy necessary for penetrating into the fabric texture. The absorption rate and diffusion speed of the dye into the fabric can be thus enhanced and a continuous dyeing and processing operation with high efficiency, low energy consumption, low bath ratio and low pollution may be achieved.

BRIEF DESCRIPTION OF THE DRAWINGS

The drawings disclose an illustrative embodiment of the present invention which serves to exemplify the various advantages and objects hereof, and are as follows:

FIG. 3 is a side view of the structure of a conventional dye padding machine;

DETAILED DESCRIPTION OF THE PREFERRED EMBODIMENT

Figure 1:
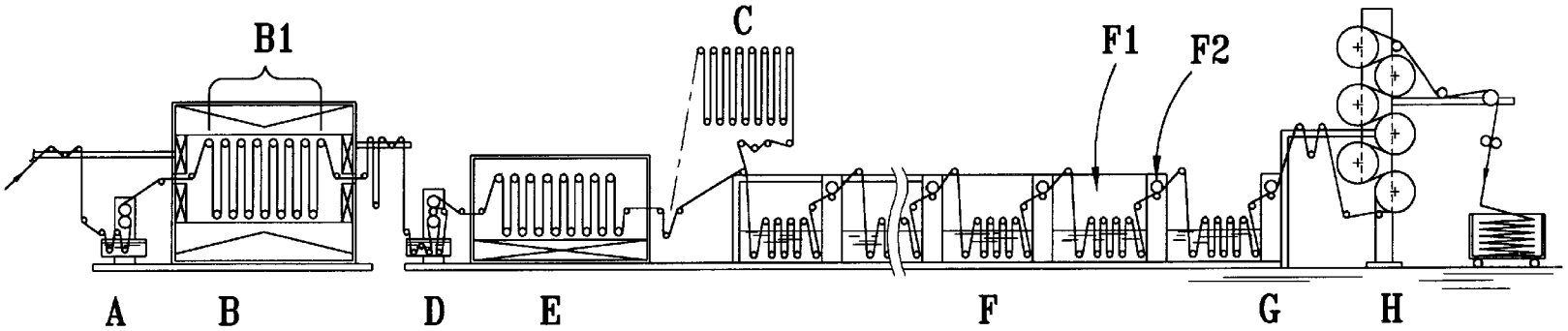
FIG. 1 PRIOR ART
FIG. 1 is a side view of the combined structure of a conventional padding type continuous dyeing machine.
Figure 2:
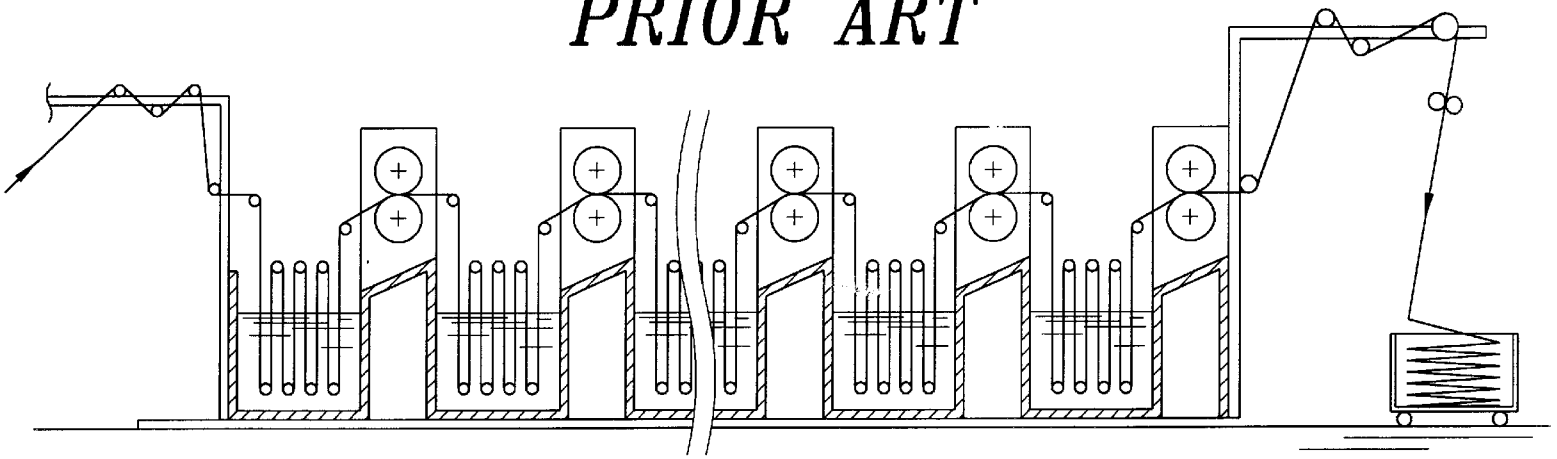
FIG. 2 PRIOR ART
FIG. 2 is a side view of the structure of a conventional continuous breadth expansion washer.
Figure 4:
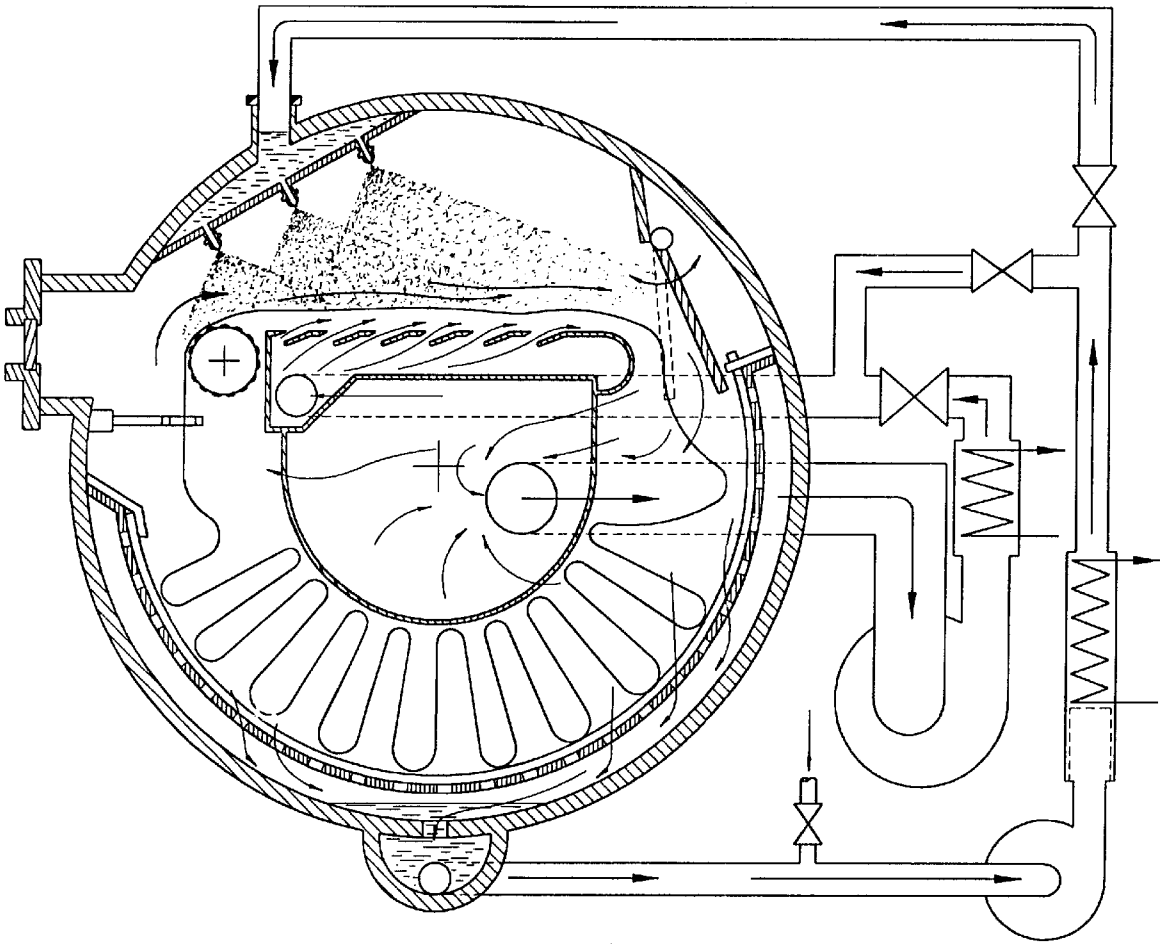
FIG. 4 PRIOR ART
FIG. 4 shows another spray dyeing apparatus with breadth expansion and vibration-enhanced dyeing operation disclosed in the R.O.C. Pat. No. 098,316, the U.S. Pat. No. 5,775,136, and the PCT Pat. No. WO98/49383.
Figure 5:
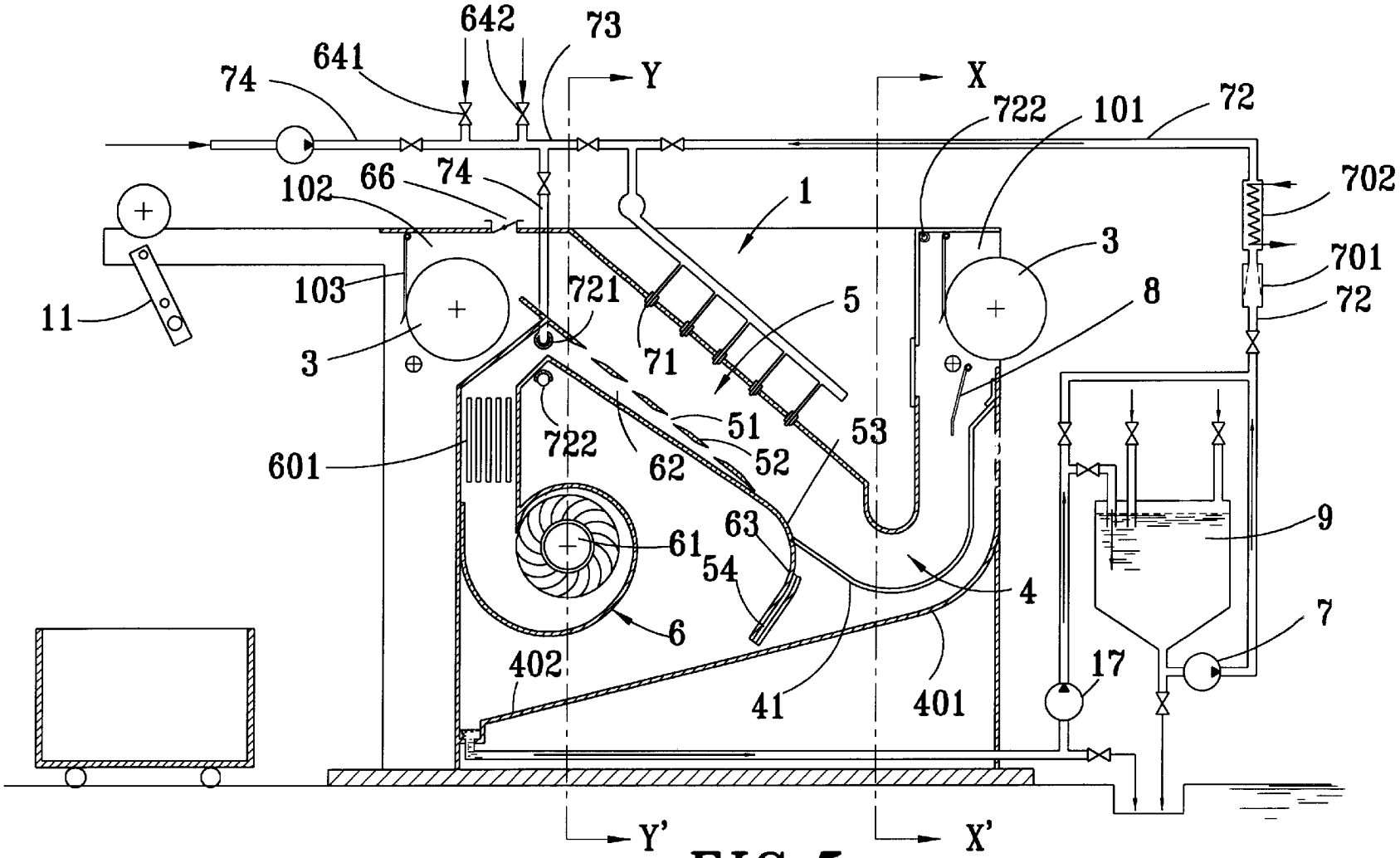
FIG. 5 is a side view of the structure of a continuous spray dyeing machine according to the present invention.
Figure 6:
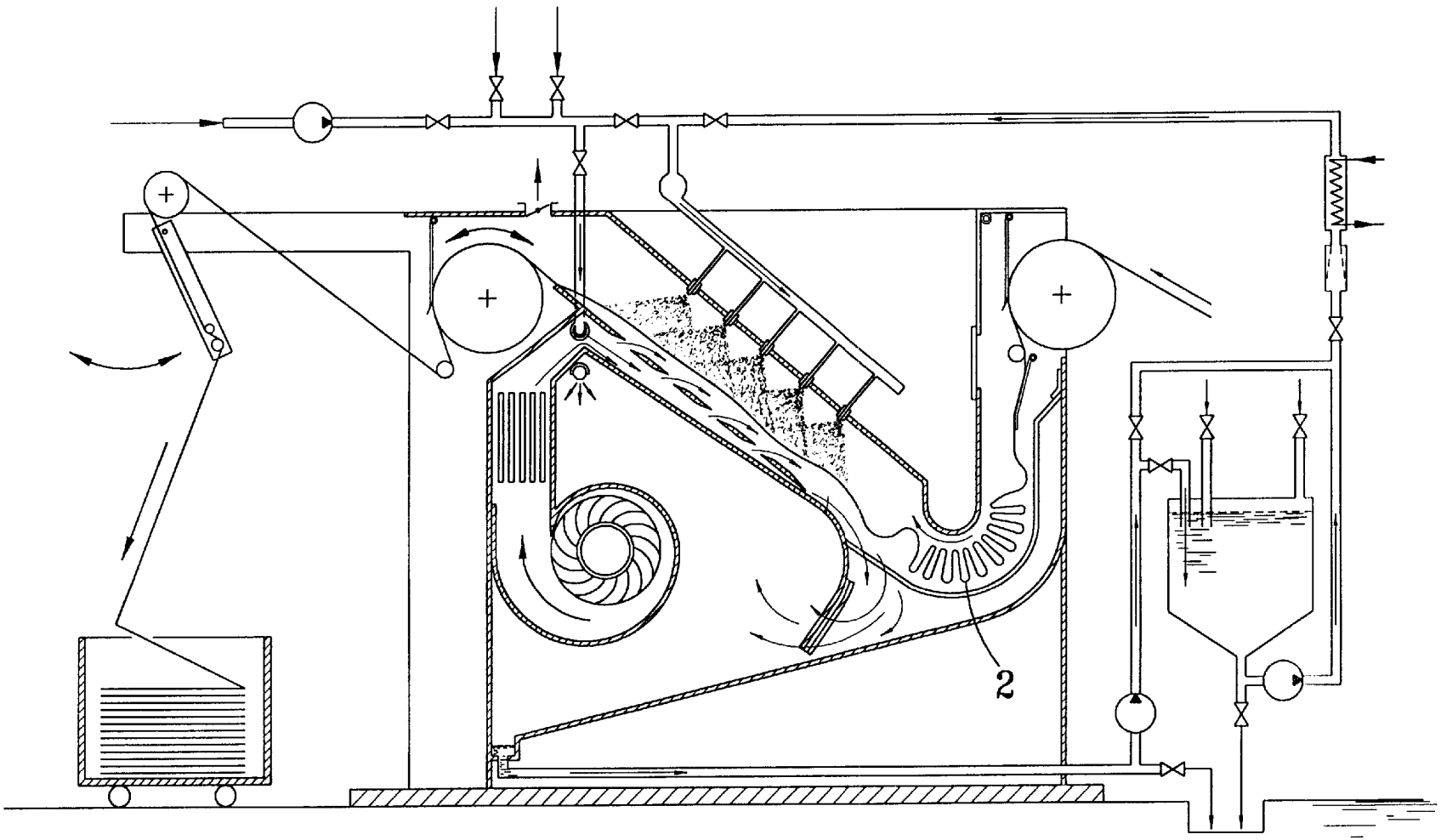
FIG. 6 is a side view of the structure and application of a continuous spray dyeing machine according to the present invention.
Figure 7:
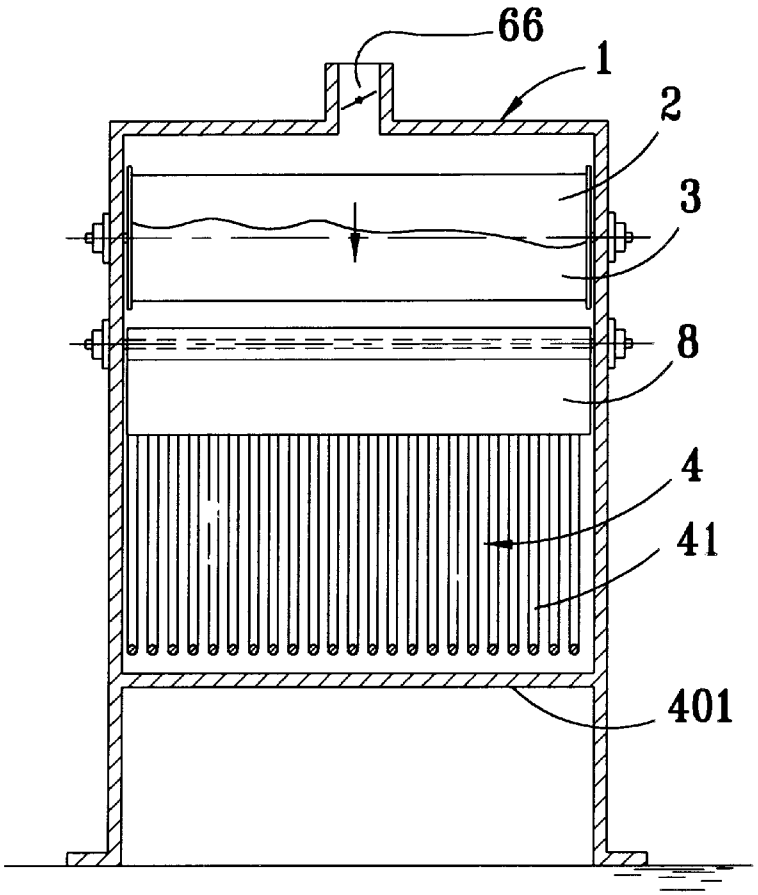
FIG. 7 is a XX' cross-sectional view of a continuous spray dyeing machine according to the present invention.
Figure 8:
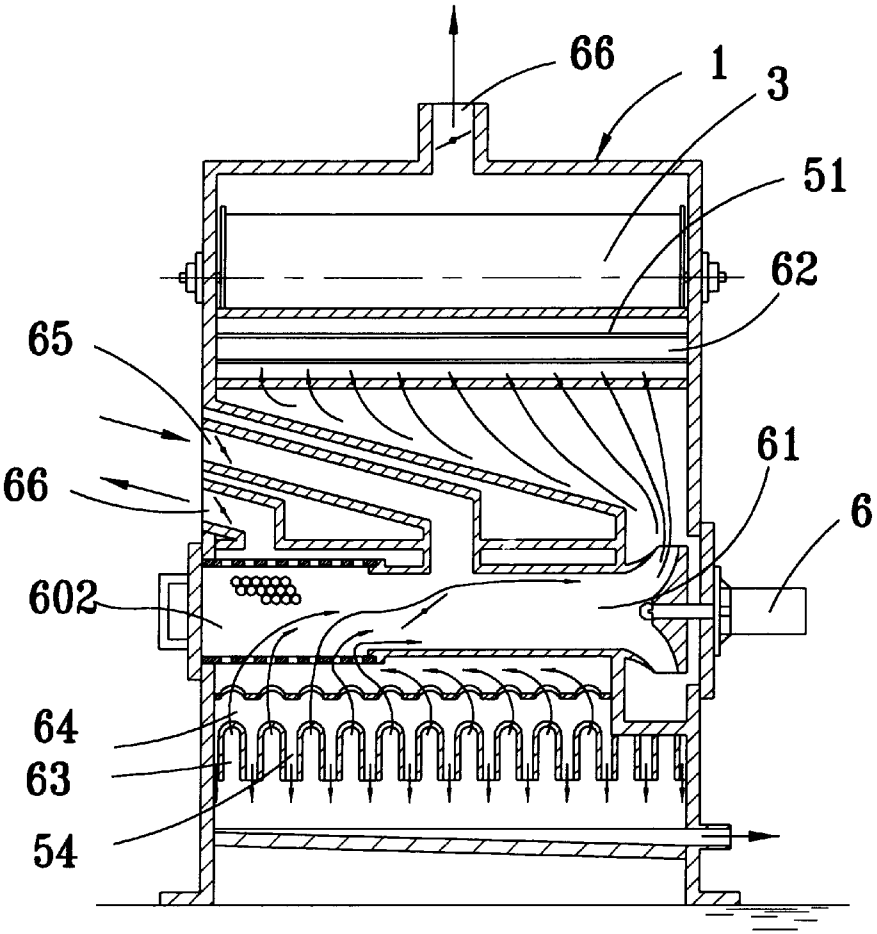
FIG. 8 is a YY' cross-sectional view of a continuous spray dyeing machine according to the present invention.
Figure 9:
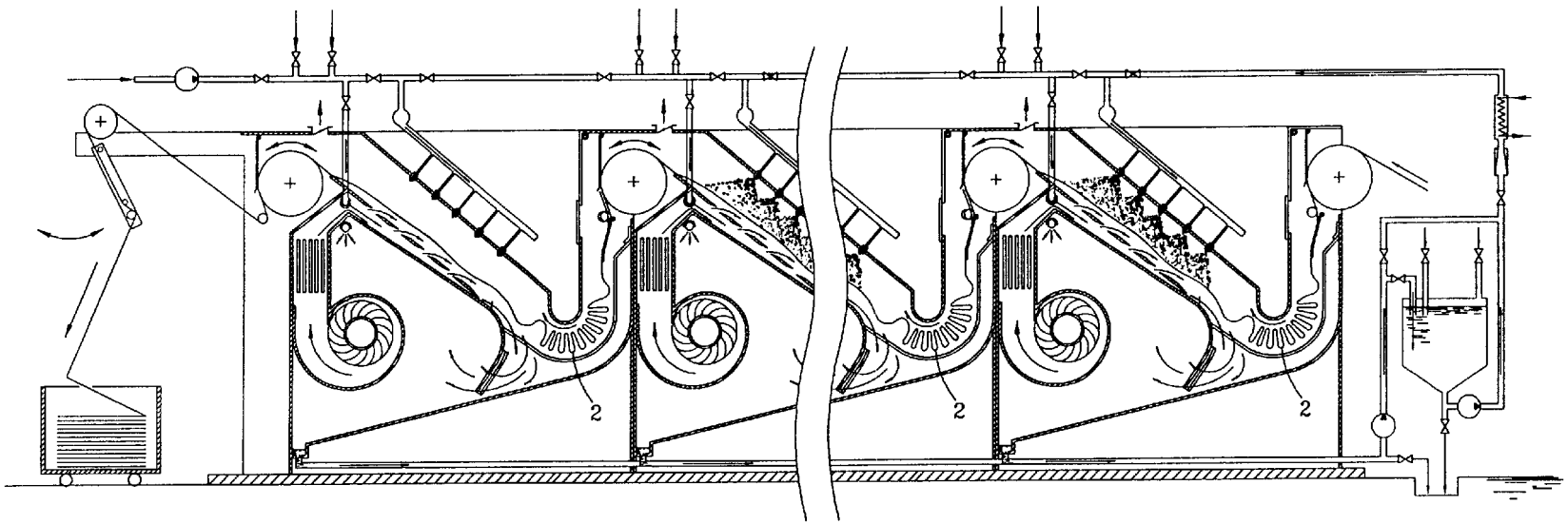
FIG. 9 is a side view of the structure and application of a continuous spray dyeing machine according to the present invention.

Please refer to FIGS. 5 and 8. FIG. 5 is a side view of the structure of a continuous spray dyeing machine according to the present invention; FIG. 8 is a YY' cross-sectional view of a continuous spray dyeing machine according to the present invention. The continuous spray dyeing machine of the present invention comprises a processing tub 1, an inlet passage 101, an outlet passage 102, a cloth collecting tub 4, a cloth guide passage 5, an air guiding nozzle 51, a reflective action base 52, an air circulation passage 63, a cloth dragging wheel 3, a blast machine 6, an air filter 602, a dye pump 7, a dye nozzle 71, a cloth wiggling machine 8, fabric sender 2, an air heater 601, a dye heater 702, a dye filter 701, a gas liquid circulation guide plate 53, a fresh air inlet 65, an exhaust outlet 66, a nitrogen inlet 641, a steam inlet 642, water inlet 74, a water nozzle 721, a jet nozzle 722, a valve 103, an outlet cloth wiggling machine 11, and a dye confluent circulation 54.

Please refer to FIGS. 5, 6, 7, 8, and 9. The processing tub 1 has the same design and specification on the front and rear sides for convenience of interconnection. An inlet passage 101 is provided above the side walls in the upstream of said processing tub passage, while an outlet passage 102 is formed above the side wall in the downstream of said processing tub passage. In addition, the left and right sides of each passage and the left and right walls of the passage in said processing tub 1 form a parallel passage with a wide open cross section for the fabric 2 to enter and pass through said processing tub 2 in a breadth expanded manner. The downstream end 402 in the lower processing tub 2 is lower than the upstream end 401. They form a slant surface with a small angle for circulation liquid to quickly gather at the lowest place and return to the dye preparation tub via a recycling pump 17. A cloth collecting tub 4 is provided in the upstream sector of said processing tub 1 passage. The tub bottom is composed of a gas liquid separation net plate 41.

A cloth guide tube 5 is formed in the down stream sector of said processing tub 1 passage. One or a plurality of dye nozzles 71 are provided on the upper side walls in said cloth guide tube 5 passage. An air distributing tube 62 is provided at the position outside the lower passage and in the same direction as said cloth guide tube 5 so that the lower flat wall of said cloth guide tube 5 and the upper wall of said air distributing tube 62 share the common wall 52. Said common wall 52 (also know as a reflective action base 52) is provided with one or a plurality of sector separated air guiding nozzles 51 along the passage on the cross section of said common wall 52. The upstream end of said common wall 52 is connected with said gas liquid separation net plate 41 under said cloth collecting tub 4. The downstream end of said common wall 52 is connected with said outlet passage 102. So said common wall 52 forms a slant angle so that the upstream end is lower than the downstream end. A cloth dragging wheel 3 is provided below said outlet passage 102. A cloth wiggling machine 8 is provided below said cloth dragging wheel 3 in the downstream direction. Said cloth wiggling machine 8 can connect via a dynamical transmission device to a wiggling plate for it to wiggle in the longitudinal direction. In the connection portion of said common wall 52 and said gas liquid separation net plate 41, a dye circulation guiding plate 53 is formed by extending said common wall 52. One or a plurality of dye confluent circulation 54 is provided in the downstream sector of said dye circulation guiding plate 53. An air circulation passage 63 is formed between said circulation 54 and the passage. Therefore, the circulation dye from said common wall 52 would not mix with the circulation airflow when passing through the confluent circulation.

On the left and right walls in the downstream and said processing tub 1 passage. A hidden blast machine 6 is provided under said air distributing tube 62. Said hidden blast machine 6 is provided with an even flow cylinder 64 at the inlet end. The inner space of said even flow cylinder is formed with an air filter 602. The outlet of said blast machine 6 is connected with said air distributing tube 62.

As described in the above continuous spray dyeing machine, dragged by said cloth dragging wheel 3, said fabric folded and collected in advance in said cloth collecting tub 4 can pass through the surface of said common wall 52 (reflective action base 52) below said cloth guide tube 5. The dye or treating agents in said preparation tub 9 can be pressurized by said dye pump 7 to go through a transmission pipe 72, a filter 701 and a heat exchanger 702 and enters said dye nozzle 71 in said cloth guide tube 5 for spraying on the upper surface of said fabric. Therefore, when dyeing or performing other processing operations, said fabric 2 can be stretched to a fully breadth expansion by the high speed air flow ejected out of said air guiding nozzle 51 and pass through said cloth guide tube 5. Said fabric 2 can be distributed and covered from above with the atomized particles of dispersed dye and treating agents ejected from said dye nozzle 71 above said cloth guide tube 5. The dyeing effect is achieved by the penetration of the dye from the top surface to the bottom. On the bottom surface of said fabric 2, a high speed air flow ejected from a plurality of sector separated air guide nozzle 51 is provided to form a levitating force for said fabric 2 in a cooperative and relay method. The air flow also produce a difference in pressure between the upper and the lower sides of said fabric 2, the lower side being lower in pressure due to the higher speed air flow while the upper side being higher in pressure due to the slower air flow. Therefore, the upper and lower air flows interact to make said fabric perform a periodically violent vibration. The upper air flow with higher pressure also force the air flow to be expelled out from the left and right sides under said fabric 2. When passing through said cloth guide tube 5, said fabric does not only have a periodically violent vibration but also gets fully stretched in the breadth direction continuously. The dye and solution not being absorbed by said fabric 2 will be sent back to said dye preparation tub 9 by a dye recycling pump 17 or be redirected to said processing tub 1 in the downstream for spraying again. If it is in the washing process, the liquid can be discharged.

The gas part is connected with said blast machine 6 by an air circulation even flow cylinder 64 (an additional circulation tube and transmission pipe should be added if a hidden blast machine is not employed) so that the air in the tub can be compressed by said blast machine 6 and sent via the transmission pipe through an air filter 602 and an air heat exchanger 601 into an air distributing tube 62. The air is then ejected toward the upstream direction of said cloth guide tube 5 by said air guiding nozzle 51 along the upper surface of said reflective action base 52. Thus, the air flow motion has an opposite direction to the motion of said fabric 2. Said fabric 2 can obtain a steady motion because the friction between said cloth dragging wheel 3 and said fabric 2 is greater than the force exerted by the air flow. Therefore, said cloth dragging wheel 3 has to provide a greater dragging force than the force exerted by the air flow so that said fabric can proceed steadily. In fact, said fabric 2 in said processing tub 1 can have its motion in the same direction as that of the air flow to facilitate dyeing. The difference between dyeing with the same direction of motion and the opposite direction of motion is not significant. However, in operation, the opposite direction of motion provides a better stability for the motion of said fabric 2 than the same direction of motion. In other words, the same direction of motion is more suitable for discontinuous dyeing machines, which had been explained in details in the previous patent of the same inventor and will not be described further herein. Basically, in the fields of discontinuous and continuous dyeing, there is a big difference in the requirement of the fabric proceeding speed. The reason is that for continuous dyeing machines, said fabric 2 only receives one process when passing through each machine, therefore in a limited equipment and time it is better to slow down the speed of said fabric 2 to ensure a complete level dyeing and a better quality. When said fabric 2 and the air flow have opposite directions of motion, the speed of said fabric 2 can be completely controlled by said cloth dragging wheel 3. Therefore, the synchronous issue is not a problem in operation. The energy of the air ejected out of said air guiding nozzle 51 can be totally converted into the energy necessary for the vibration of said fabric 2. In addition, another object is that most of the pollution materials can be removed along with the air flow and circulation liquid in dyeing or impurity processing. Furthermore, a washing nozzle 721 is provided on the upstream end within said air distributing tube 62 and connected with a high pressure washing pump or a water tank by said transmission pipe 74. Another transmission pipe 73 is formed on said transmission pipe 74 and connects to said dye transmission pipe 72. A reverse control valve is provided in each pipeline to control the ejection of water or the mixture of water and dye by opening and closing of the valve when washing or dyeing a particularly compact fabric. The ejected liquid is then ejected toward and mixed with the air flow in said air distributing tube 62 so that the large amount of water or dye ejected out of said air guiding nozzle 51 can get in touch with said fabric 2. This allows the impurities or treating agents remaining on said fabric 2 to quickly diffuse into water. Even if said fabric 2 is dyed on both sides, another steam pipe can be provided on said transmission pipe 74 and a reverse control valve 641 can directly provides the necessary temperature in said processing tub 1.

When said fabric 2 enters the next processing tub 1, the action of said wiggling plate 8 can make said fabric 2 fall into said cloth collecting tub 4 and get the best folding. To facilitate the examination procedure, the following paragraph further explains in details the effect happening in said cloth guide tube.

According to the Bernoulli's law, "the place where the flowing liquid or gas has a faster speed has a lower pressure." Therefore, as describe above, when a high speed air flow is formed under said fabric 2, the pressure below said fabric 2 is lower than the pressure thereabout because of a slow air flow. So said fabric 2 will be dragged toward the high speed air flow area due to both the pressure difference and the gravity 8. Thus said fabric 2 has a close contact with the high speed air flow and the friction in between increases so that said fabric 2 obtained the most energy from the air flow. Thus, whenever said fabric 2 gets close to the mainstream of the high speed air flow, it will be drawn by the air flow and could not keep going forward. Since the mainstream of the high speed air flow has a greater kinematic energy, said fabric 2 moving forward would get continuously levitated and move above the flat wall to prevent the friction between said fabric 2 and the pipe wall. Whenever said fabric 2 is forced into the mainstream area of the high speed air flow, the air flow would generate a pressure peak and force said fabric 2 to quickly move away from the mainstream area. The generation of the pressure peak is caused by the conversion of the kinematic energy into the pressure energy due to resistance. It can be affected by the reflection of said flat reflective action base 52 and due to the same phase as another peak so that another pressure peak can be produced instantaneously. This pressure peak continuously happens to said fabric 2 in a periodic way along said cloth guide tube 5. Therefore, any part of said fabric 2 can have a periodic vibration. The vibration frequency is determined not only by the mass of said fabric 2 but also by the momentum of the air flow. Thus, in dyeing or processing operations, both the opening extent of said air guiding nozzle 51 and the output power of the blast machine can control the vibration frequency. The generation of the above periodic wavy vibration is the effect of the work done by a large amount of energy. Each vibration does not only loosen the texture structure of said fabric 2 so that the dye can have its circulation passage, but also make the dye obtain the energy necessary for penetrating into the texture. This further enhances the absorption rate and diffusion speed of the dye on the fabric. Accordingly, in the process of dyeing, in addition to obtaining the small amount high concentration, high efficiency, low energy consumption, low bathing ratio and low pollution dyeing, the fabric can also achieve the deboundling and relaxing effects via the periodic violet vibration. At the same time, the impurities on the fiber can be so efficiently removed that processing operations such as desizing, scouring, bleaching, reduction, enzyme treating, soaping, washing can be quickly finished. Thus the invention can achieve the goal of both dyeing and further processing operations within an extremely short period of time.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A spray dyeing machine comprising:

a processing tub having a wide passage, an upstream sector and a downstream sector for a fabric to pass therethrough for dyeing and other process operations, said processing tub including an upstream side wall, an upper end of said upstream side wall and an inlet passage on said upper end of said upstream side wall and said processing tub including a downstream side wall, an upper end of said downstream side wall and an outlet passage on said upper end of said downstream side wall;

a cloth dragging wheel at each of said inlet and said outlet passages and a cloth collecting tub disposed below said inlet passage in said upstream sector of said passage in said processing tub;

a cloth guide tube having upper side walls angularly disposed between said cloth collecting tub and said outlet passage so that the downstream end of said cloth guide tube is higher than its upstream end;

a dye nozzle formed on said upper side walls of said cloth guide tube, a pipe and a dye pump connected to said dye nozzle by said pipe for pumping dye or treating liquid through said nozzle whereby the dye or treating liquid is sprayed on a large area of fabric;

a plurality of sector separated air guiding nozzles formed along said passage in a lower portion of said side walls of said cloth guide tube;

a reflective action base having an upper surface formed in a downstream direction of said air guiding nozzles, a blast machine and a pipe for connecting said blast machine to said guiding nozzles and for providing pressurized air to and through said air guiding nozzles in the form of an air flow whereby the action of the air flow along said upper surface of said reflective action base toward the upstream direction of the fabric so that the pressure below the fabric is lower due to a higher speed of air flow and the pressure above is higher due to a slower air flow, and the upper and lower air flows interact to ensure that the fabric passes through said cloth guide tube with a periodic vibration, said fabric being continuously pushed due to the pressure difference and gravity and having close contact with the air flow to thereby increase the conversion rate so that dye penetrates into the fabric.

2. The spray dyeing machine as claimed in claim 1, which further comprises a dragging-type gas liquid circulation guide plate having a downstream sector and a separation type gas liquid circulation passage provided between said cloth guide tube and said cloth collecting tub; and a net under said cloth collecting tub; wherein said gas liquid circulation guide plate is formed by extending said reflective action base and forms an arc circulation in the downstream sector of said gas liquid circulation guide plate, a plurality of liquid confluent pipes and an air passage formed between said liquid confluent pipes so that liquid can pass through said confluent pipes along said gas liquid circulation guide plate due to the dragging of said dragging type gas liquid circulation guide plate, so that the airflow under said fabric can circulate and pass through said net under said cloth collecting tube and be redirected into said blast machine via said air circulation passage.

3. The spray dyeing machine as claimed in claim 1 which further comprises a spray nozzle device comprising a plurality of nozzles and a passage pipe, provided with said plurality of nozzles, a dye transmission pipe connected to an end of said passage pipe, a pressurized pump and a steam transmission pipe and a control valve provided so that the dye water or stain can be guided to said nozzle on said air distributing passage.

4. The spray dyeing machine as claimed in claim 1, which further comprises a cloth wiggling machine provided under said cloth dragging wheel on the upstream side of said processing tub; said cloth wiggling machine comprising a wiggling plate, a transmission axis on one end of said wiggling plate, a driving rod, a driver; wherein said wiggling plate can be fixed on said transmission axis, with one end extending outside the tub wall and connecting with said driver, so that said wiggling plate can perform longitudinal reciprocating motion and said fabric passing said wiggling plate falls into said cloth collecting tub.

5. The spray dyeing machine as claimed in claim 1, which further comprises an air inlet and an exhaust outlet provided on the blast machine inlet passage; an exhaust hot air outlet and a nitrogen inlet provided on the side walls of said processing tub; and a treating liquid recycling outlet at the bottom of said processing tub; wherein a control valve is provided on each of said inlets and outlets and the air supply in said processing tub can be controlled.

6. The spray dyeing machine as claimed in claim 1, which further comprises a heat exchanger, a filter, and a dye transmission or circulation passage connected to said heat exchanger and said filter.

7. The spray dyeing machine as claimed in claim 1, which further comprises a high pressure pump and a water nozzle provided in said processing tub; wherein said water nozzle is connected to said high pressure pump so that the water can be guided into said nozzle for ejecting toward the fabric when each dyeing process is completed.

* * * * *